US009039397B2

(12) United States Patent
Fujiki et al.

(10) Patent No.: US 9,039,397 B2
(45) Date of Patent: May 26, 2015

(54) ROTOR FOR OIL PUMP WITH DIFFERENT CONTOURS FOR THE DRIVE-SIDE VERSUS NON-DRIVE SIDE OF THE TEETH

(71) Applicant: YAMADA MANUFACTURING CO., LTD, Kiryu-shi, Gunma (JP)

(72) Inventors: Kenichi Fujiki, Isesaki (JP); Masato Izutsu, Isesaki (JP); Takatoshi Watanabe, Isesaki (JP)

(73) Assignee: Yamada Manufacturing Co., Ltd., Kiryu-shi, Gunma (JP)

( * ) Notice: Subject to any disclaimer, the term of this patent is extended or adjusted under 35 U.S.C. 154(b) by 63 days.

(21) Appl. No.: 13/903,877

(22) Filed: May 28, 2013

(65) Prior Publication Data

US 2013/0323106 A1 Dec. 5, 2013

(30) Foreign Application Priority Data

Jun. 1, 2012 (JP) ..... 2012-126214

(51) Int. Cl.
*F04C 2/10* (2006.01)
*F04C 2/06* (2006.01)
*F04C 2/08* (2006.01)

(52) U.S. Cl.
CPC . *F04C 2/10* (2013.01); *F04C 2/084* (2013.01); *F04C 2/102* (2013.01)

(58) Field of Classification Search
USPC ..... 418/171, 166
See application file for complete search history.

(56) References Cited

U.S. PATENT DOCUMENTS 2,389,728 A * 11/1945 Hill ..... 418/166
5,114,325 A * 5/1992 Morita ..... 418/171
5,454,702 A * 10/1995 Weidhass ..... 418/171
5,876,193 A * 3/1999 Hosono et al. ..... 418/171

FOREIGN PATENT DOCUMENTS

JP 2011-17318 A 1/2011

* cited by examiner

*Primary Examiner* — Mary A Davis
(74) *Attorney, Agent, or Firm* — McGinn IP Law Group, PLLC

(57) ABSTRACT

A rotor for an oil pump according to the present invention is a rotor that includes an inner rotor configured by teeth, each of which has a plurality of ellipses or circles, and an outer rotor that is disposed on the outside of the inner rotor and has one tooth more than the inner rotor, wherein, in a tooth of the inner rotor, a tooth top and a tooth root of a drive-side half-tooth region extending from the tooth top to the tooth root and a tooth top and a tooth root of a non-drive-side half-tooth region extending from the tooth top to the tooth root are each configured by a different ellipse or a circle. A circumferential axis along a circumferential direction of the ellipse or circle configuring the tooth top is longer in the non-drive-side half-tooth region than in the drive-side half-tooth region.

16 Claims, 5 Drawing Sheets

ENLARGED VIEW OF PART ( β )

ROTOR FOR OIL PUMP WITH DIFFERENT CONTOURS FOR THE DRIVE-SIDE VERSUS NON-DRIVE SIDE OF THE TEETH

BACKGROUND OF THE INVENTION

1. Field of the Invention

The present invention relates to a rotor for an oil pump that is capable of reducing noise.

2. Description of the Related Art

Many of the conventional oil pumps are internal gear pumps that use trochoidal gears. For the purpose of improving the performances of these pumps, attempts have been made to change the shapes of details of the teeth of the outer rotor and the inner rotor in these pumps. Examples of the improved pumps include the one described in Japanese Patent Application Publication No. 2011-17318 ("Patent Document 1," hereinafter).

In Patent Document 1, one of the teeth of the inner rotor is constructed with a part of a curve extending along the circumferential axis of the ellipse of the tooth. As shown in FIGS. 6, 7, 8 and the like of Patent Document 1, the angle of each tooth curve of the inner rotor changes suddenly at the inflection point at which the ellipses are connected to each other. Rattling sound occurs when the outer rotor passes the inflection point where the angle suddenly changes. The problem in Patent Document 1, therefore, is this resultant loud noise. An object of the present invention (technical problem that the present invention intends to solve) is to provide a rotor for an oil pump that is capable of reducing noise.

SUMMARY OF THE INVENTION

As a result of keen studies to achieve the object described above, the inventors of the present invention contrived a rotor for an oil pump, which, in a first aspect of the present invention, includes an inner rotor configured by teeth, each of which has a plurality of ellipses or circles, and an outer rotor that is disposed on the outside of the inner rotor and has one tooth more than the inner rotor, wherein, in a tooth of the inner rotor, a tooth top and a tooth root of a drive-side half-tooth region extending from the tooth top to the tooth root and a tooth top and a tooth root of a non-drive-side half-tooth region extending from the tooth top to the tooth root are each configured by a different ellipse or a circle, and a circumferential axis along a circumferential direction of the ellipse or circle configuring the tooth top is longer in the non-drive-side half-tooth region than in the drive-side half-tooth region. For a second aspect of the present invention, the inventors contrived a rotor for an oil pump according to the first aspect, wherein a circumferential axis along a circumferential direction of the ellipse or circle configuring the tooth root is longer in the non-drive-side half-tooth region than in the drive-side half-tooth region.

In order to achieve the object described above, the inventors of the present invention contrived a rotor for an oil pump, which, in a third aspect of the present invention, includes an inner rotor configured by teeth, each of which has a plurality of ellipses or circles, and an outer rotor that is disposed on the outside of the inner rotor and has one tooth more than the inner rotor, wherein, in a tooth of the inner rotor, a tooth top and a tooth root of a drive-side half-tooth region extending from the tooth top to the tooth root and a tooth top and a tooth root of a non-drive-side half-tooth region extending from the tooth top to the tooth root are each configured by a different ellipse or a circle, and a sum of the length of a circumferential axis along a circumferential direction of the ellipse or circle configuring the tooth top and the length of a circumferential axis along a circumferential direction of the ellipse or circle configuring the tooth root is greater in the non-drive-side half-tooth region than in the drive-side half-tooth region.

According to the first aspect of the present invention, the length of the circumferential axis along the circumferential direction of the ellipse or circle configuring the tooth top is longer in the non-drive-side half-tooth region than in the drive-side half-tooth region. Thus, a tangent line to the contour line of an intermediate region between the tooth root and the tooth top of the drive-side half region has a gentle slope with respect to a virtual centerline connecting the rotation center of the inner rotor and the tooth top of the tooth of the inner rotor, whereas a tangent line to the contour line of an intermediate region between the tooth top and the tooth root of the non-drive-side half-tooth region has a steep slope.

In other words, the intermediate region of the drive-side half-tooth region is formed to have a relatively gentle slope, whereas the intermediate region of the non-drive-side half-tooth region is formed to have a relatively steep slope. Therefore, in the drive-side half-tooth region overall, the inflection point between tooth-forming circles configured by the plurality of ellipses or circles draws a gentle curve without having the angle at the inflection point changed drastically. Accordingly, the rattling sound (the sound generated when a tooth of the outer rotor passes the corresponding tooth of the inner rotor) can be prevented from occurring on the drive side when the rotors of the oil pump are rotated, reducing noise of the rotors of the oil pump.

Moreover, the somewhat upright configuration of the intermediate region in the non-drive-side half-tooth region can reduce the backlash clearance between the tooth of the inner rotor and the tooth of the outer rotor. Reducing the backlash clearance can further reduce noise (the sound generated when the tooth of the inner rotor and the tooth of the outer rotor collide against each other in a radial direction).

According to the second aspect of the present invention, a circumferential axis along a circumferential direction of the ellipse or circle configuring the tooth root is longer in the non-drive-side half-tooth region than in the drive-side half-tooth region. The contour line of the drive-side half-tooth region can be formed into a smooth curve with a gentler slope, establishing smooth contact between the tooth of the inner rotor and the tooth of the outer rotor and reducing the noise that is generated when the teeth come into contact with each other.

According to the third aspect of the present invention, the outline of the drive-side half-tooth region of the tooth of the inner rotor can be configured to have an excellent curve, and the tooth of the inner rotor and the tooth of the outer rotor can be brought into smooth contact with each other, reducing the noise that is generated when the teeth come into contact with each other. In other words, the rattling sound on the drive side and the sound caused by the backlash on the non-drive side can be reduced.

DESCRIPTION OF THE PREFERRED EMBODIMENTS

An embodiment of the present invention is described hereinafter with reference to the drawings. A pump rotor of the present invention is a gear-type rotor configuring an internal gear pump. This type of rotor generally has a combination of an inner rotor 1 and an outer rotor 2 that is disposed on the outside of the inner rotor 1 and rotates. The toothed inner rotor 1 with external teeth A is disposed on the inside of the annular outer rotor 2 having internal teeth. The outer rotor 2 rotates as the inner rotor 1 rotates.

The inner rotor 1 is mainly described with regard to the pump rotor of the present invention. The inner rotor 1 here has six teeth; however, the number of teeth of the inner rotor 1 is not limited thereto and can be determined appropriately. First, the teeth A of the inner rotor 1 consist of a drive-side half-tooth region A1 and a non-drive-side half-tooth region A2.

Figure 1:
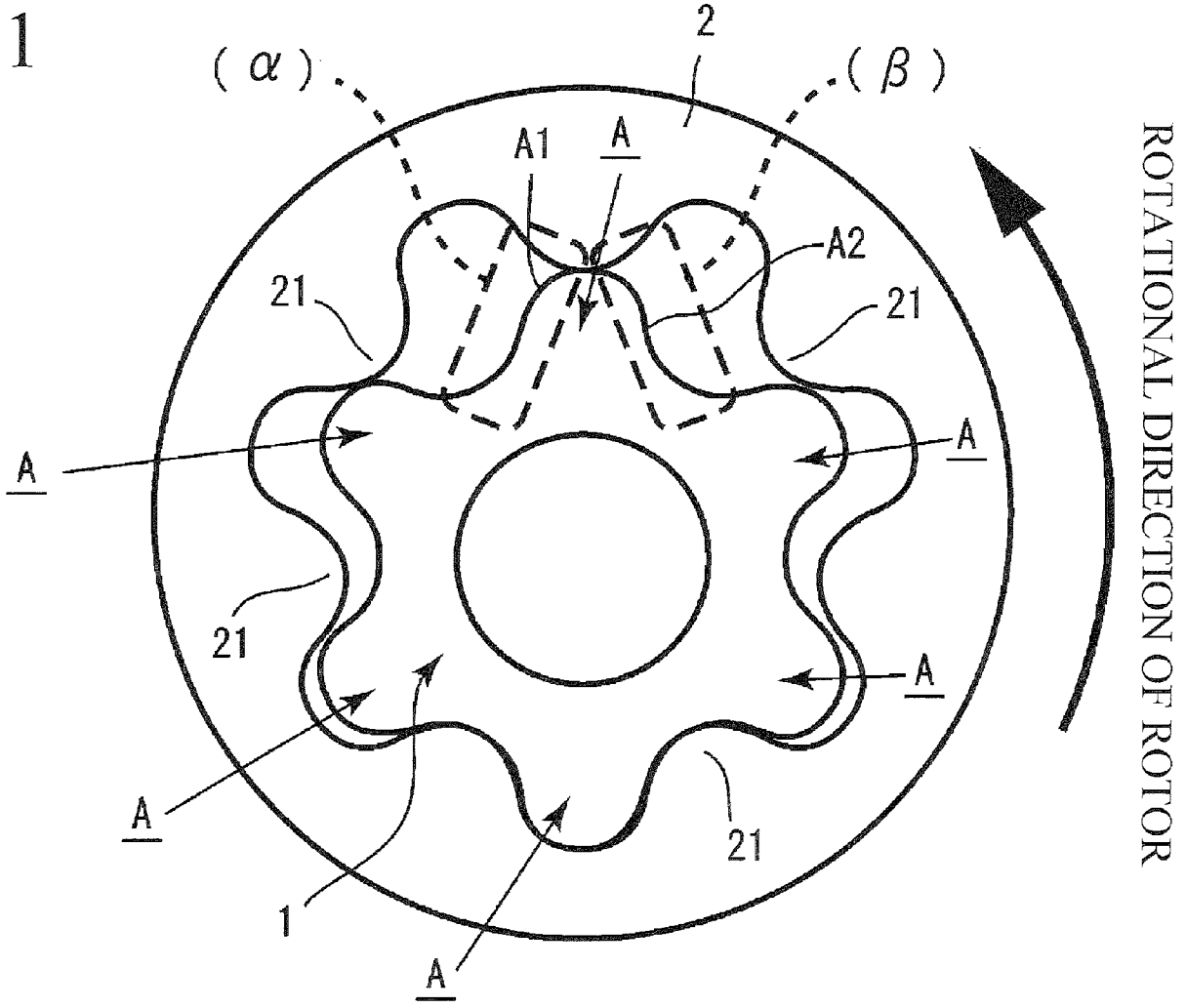
FIG. 1 is a front view of a pump rotor according to the present invention.
Figure 2:
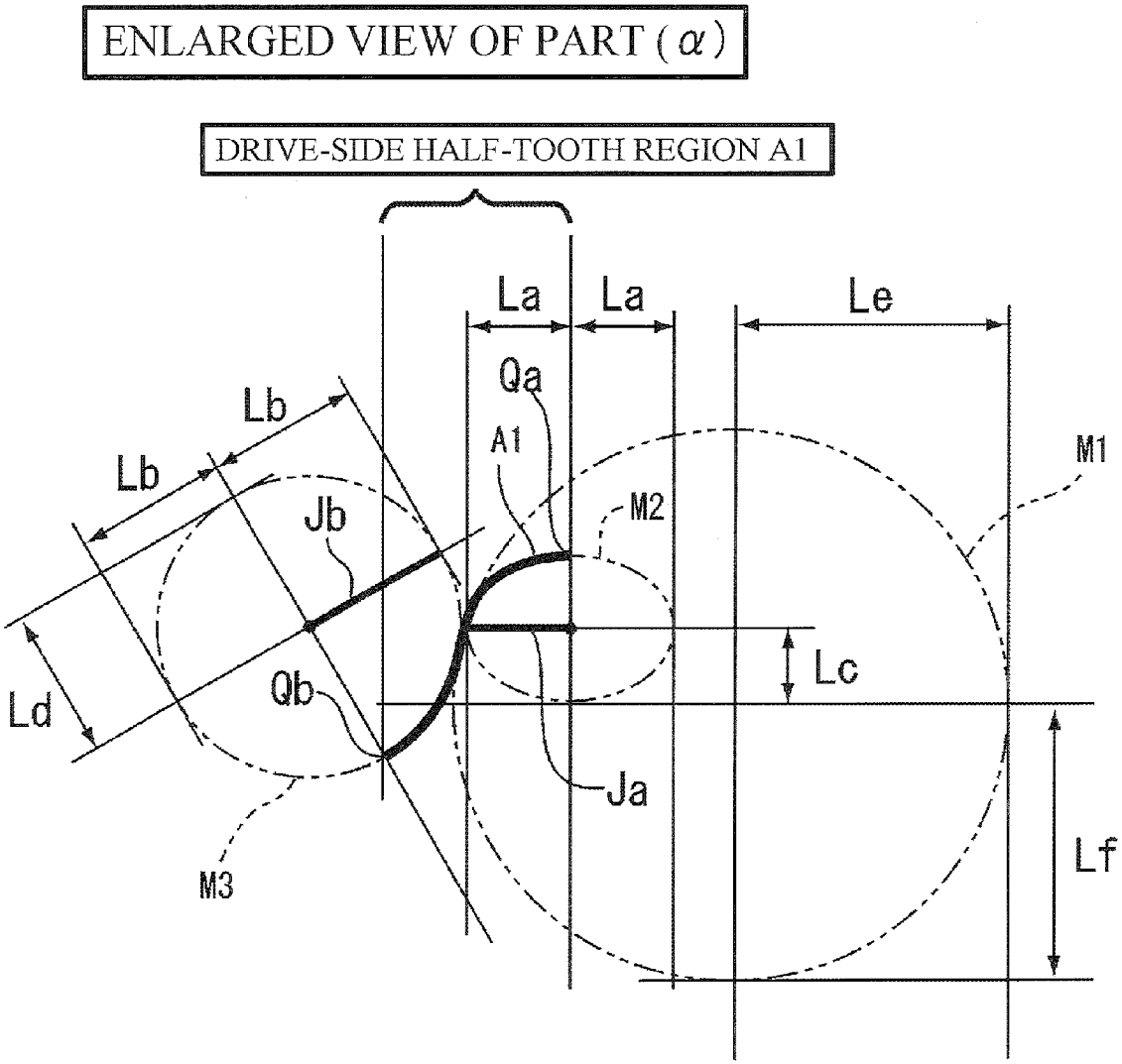
FIG. 2 is an enlarged view of part ($\alpha$) shown in FIG. 1.
Figure 3:
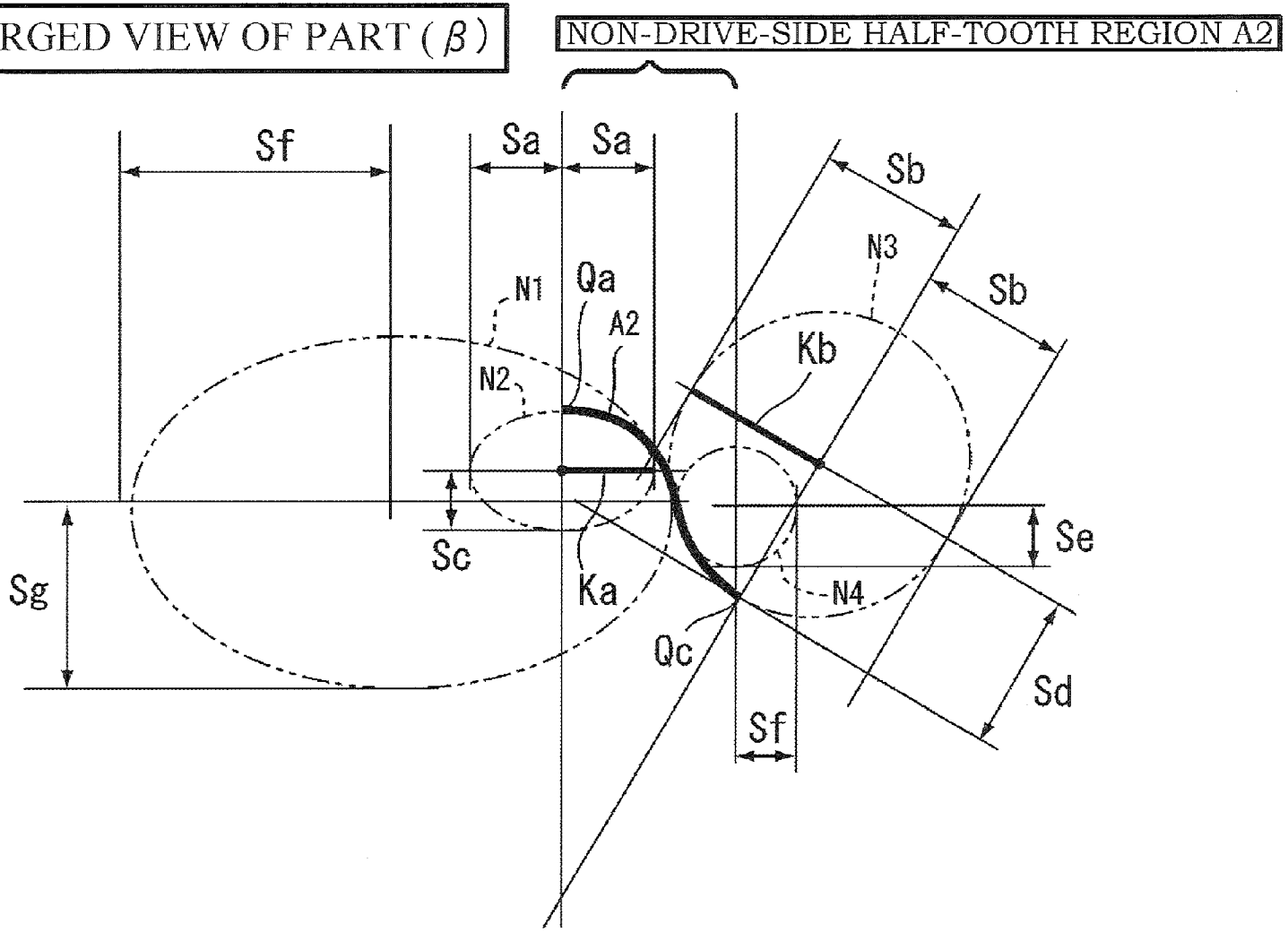
FIG. 3 is an enlarged view of part ($\beta$) shown in FIG. 1.

One of the teeth A moves starting from the drive-side half-tooth region A1 to the non-drive-side half-tooth region A2, through a tooth root Qb, a tooth top Qa, and then a tooth root Qc (see FIGS. 1 to 3). Since the teeth A and the like of the inner rotor 1 of the present invention all have the same shape, the shape is now described using one of the teeth A.

As described above, the region extending from the tooth top Qa of the tooth A to the tooth root Qb on one side of the tooth A is referred to as "drive-side half-tooth region A1," and the region extending from the tooth top Qa to the tooth root Qc on the other side of the tooth A is referred to as "non-drive-side half-tooth region A2." The line that connects a rotation center P of the inner rotor 1 and the tooth top Qa of the tooth A is referred to as "virtual centerline L."

The tooth A has the drive-side half-tooth region A1 on one side with respect to the virtual centerline L and the non-drive-side half-tooth region A2 on the other side. In FIG. 1, the rotors rotate counterclockwise; thus, the left-hand side of the virtual centerline L constitutes the drive-side half-tooth region A1 and the right-hand side the non-drive-side half-tooth region A2.

The drive-side half-tooth region A1 corresponds to a half-tooth region located forward with respect to the rotational direction in the tooth A of the inner rotor 1, and the non-drive-side half-tooth region A2 corresponds to a half-tooth region located rearward with respect to the rotational direction of the inner rotor 1. In other words, when rotated, the drive-side half-tooth region A1 presses the internal teeth of the outer rotor 2 to rotate the outer rotor 2.

The tooth A is configured by a plurality of large and small tooth-forming circles. The tooth-forming circles can be circles (perfect circles) or ellipses. A group of tooth-forming circles M1, M2, M3 and the like (see FIG. 2) constituting the drive-side half-tooth region A1 and a group of tooth-forming circles N1, N2, N3 and the like (see FIG. 3) constituting the non-drive-side half-tooth region A2 have shapes and sizes different from each other. In other words, the drive-side half-tooth region A1 and the non-drive-side half-tooth region A2 of the tooth A are not in the same symmetrical shape but in an asymmetrical shape.

First, the drive-side half-tooth region A1 is configured by the plurality of tooth-forming circles M1, M2, M3 and the like (see FIG. 2). Similarly, the non-drive-side half-tooth region A2 is configured by the plurality of tooth-forming circles N1, N2, N3 and the like (see FIG. 3). The tooth-forming circles M1, M2, M3 and the like are in the shape of an ellipse or a perfect circle and are different in size. The tooth-forming circles N1, N2, N3 and the like also are in the shape of an ellipse or a perfect circle and are different in size.

As shown in FIG. 2, of the tooth-forming circles M1, M2, M3 and the like constituting the drive-side half-tooth region A1, the small tooth-forming circle is encircled in the large tooth-forming circle, the small and large tooth-forming circles being partially in contact with each other, forming the line connecting the tooth top Qa and the tooth root Qb. Similarly, as shown in FIG. 3, of the tooth-forming circles N1, N2, N3 and the like constituting the non-drive-side half-tooth region A2, the small tooth-forming circle is encircled in the large tooth-forming circle, the small and large tooth-forming circles being partially in contact with each other, forming the line connecting the tooth top Qa and the tooth root Qc.

In the embodiment of the drive-side half-tooth region A1, the small elliptic tooth-forming circle M2 is encircled in the large, perfectly round tooth-forming circle M1, both circles being partially in contact with each other, as shown in FIG. 2. The tooth-forming circle M2 configures the top of the tooth in the drive-side half-tooth region A1. A circumferential axis Ja of the small elliptic tooth-forming circle M2 is set along a circumferential direction of the inner rotor 1. The circumferential axis Ja is provided in order to determine the shape of the top of the tooth in the drive-side half-tooth region A1.

The tooth-forming circle M3, on the other hand, configures the root of the tooth of the drive-side half-tooth region A1. A circumferential axis Jb of the tooth-forming circle M3 is set along the circumferential direction of the inner rotor 1. The circumferential axis Jb is provided in order to determine the shape of the root of the tooth in the drive-side half-tooth region A1. The tooth-forming circle M1 configures the part where the top and root of the tooth in the drive-side half-tooth region A1 are connected to each other. The outline of the drive-side half-tooth region A1 forms a smooth curve.

In the embodiment of the non-drive-side half-tooth region A2, the small elliptic tooth-forming circle N2 is encircled in the large elliptic tooth-forming circle N1, both circles being partially in contact with each other. A circumferential axis Ka of the small elliptic tooth-forming circle N2 is set along the circumferential direction of the inner rotor 1. The tooth-forming circle N2 configures the top of the tooth in the non-drive-side half-tooth region A2. A circumferential axis Kb of the large elliptic tooth-forming circle N3 is set along the circumferential direction of the inner rotor 1. The circumferential axis Ka is provided in order to determine the shape of the top of the tooth in the non-drive-side half-tooth region A2.

The circumferential axes Ja, Jb of the drive-side half-tooth region A1 and the circumferential axes Ka, Kb of the non-drive-side half-tooth region A2 are half the lengths of the major axes and minor axes of the tooth-forming circles M1, M2, M3 and the like as well as the tooth-forming circles N1, N2, N3 and the like. Therefore, the major axes or minor axes of the tooth-forming circles M1, M2, M3 and the like are obtained by doubling the lengths of the circumferential axes Ja, Jb. Similarly, the major axes or minor axes of the tooth-forming circles N1, N2, N3 and the like can be obtained by doubling the lengths of the circumferential axes Ka, Kb.

A small, perfectly round tooth-forming circle N4 is encircled in the large elliptic tooth-forming circle N3, both circles being partially in contact with each other. The large elliptic tooth-forming circle N3 configures the root of the tooth in the non-drive-side half-tooth region A2. The circumferential axis Kb of the tooth-forming circle N3 is set along the circumferential direction of the inner rotor 1. The circumferential axis Kb determines the shape of the root of the tooth in the non-drive-side half-tooth region A2. The tooth-forming circle N4 configures the part where the top and root of the tooth in the non-drive-side half-tooth region A2 are connected to each other. The outline of the non-drive-side half-tooth region A2 forms a smooth curve.

The circumferential axes Ja, Jb, formed along the circumferential direction of the tooth-forming circles configuring respectively the top and root of the tooth in the drive-side half-tooth region A1, and the circumferential axes Ka, Kb, formed along the circumferential direction of the tooth-forming circles configuring respectively the top and root of the tooth in the non-drive-side half-tooth region A2, are configured in such a manner that the non-drive-side half-tooth region A2 is larger than the drive-side half-tooth region A1.

Therefore, the lengths of the circumferential axes Ja, Jb of the drive-side half-tooth region A1 and the lengths of the circumferential axes Ka, Kb of the non-drive-side half-tooth region A2 have the following relationships:

$$La<Sa$$

$$Lb<Sb$$

$$(La+Lb)<(Sa+Sb)$$

where La represents the length of the circumferential axis Ja, Sa represents the length of the circumferential axis Ka, Lb represents the length of the circumferential axis Jb, and Sb represents the length of the circumferential axis Kb.

Although the drive-side half-tooth region A1 and the non-drive-side half-tooth region A2 are asymmetric with respect to the line connecting the rotation center P of the inner rotor and the tooth root Qb of the tooth A, the rotational direction of the inner rotor determines which side the drive-side half-tooth region A1 or the non-drive-side half-tooth region A2 should be positioned. In the tooth A, the drive-side half-tooth region A1 is always located forward with respect to the rotational direction.

Specific values are now assigned to the drive-side half-tooth region A1 and the non-drive-side half-tooth region A2. First, for the small, elliptic tooth-forming circle M2 configuring the top of the tooth in the drive-side half-tooth region A1, the length of the circumferential axis Ja is 4.3 mm, and the length of the minor axis (half the length thereof) is 3.1 mm. In other words, the circumferential axis Ja here corresponds to the major axis of the ellipse. The large, perfectly round tooth-forming circle M3 configuring the root of the tooth has a diameter of 6.45 mm. When the large, perfectly round tooth-forming circle M3 is considered as an ellipse in which the major axis and the minor axis have the same length, the diameter of the tooth-forming circle M3 corresponds to the circumferential axis.

Similarly, for the small, elliptic tooth-forming circle N2 configuring the top of the tooth in the non-drive-side half-tooth region A2, the length of the circumferential axis Ka is 4.45 mm, and the length of the minor axis (half the length thereof) is 3.1 mm. The length of the circumferential axis of the large, elliptic tooth-forming circle N3 configuring the root of the tooth is 7.3 mm, and the length of the major axis thereof (half the length thereof) is 7.6 mm. Note that the diameter of the small perfect circle that connects the top and root of the tooth is 6 mm.

In the non-drive-side half-tooth region A2 shown in FIG. 3, the circumferential axis of the ellipse including the tooth top Qa (the circumferential axis being 4.45 mm long) is disposed horizontally along the circumferential direction of the inner rotor. In the non-drive-side half-tooth Tegion A2 shown in FIG. 3, the minor axis of the ellipse including the tooth root Qc (the circumferential axis being 7.3 mm long) is disposed obliquely along the circumferential direction of the inner rotor in such a manner as to extend from the upper left toward the lower right.

As described above, the tooth A of the inner rotor 1 according to the present invention has the drive-side half-tooth region A1 and the non-drive-side half-tooth region A2 that are in an asymmetrical relationship. Each of these regions configures a half the tooth, hence the same angle in the tooth curve. Because the connections between the tooth tops and between the tooth roots are established in FIGS. 2 and 3, the positions of the tooth tops in the radial direction (the length of the diameter) coincide with the positions of the tooth roots in the radial direction (the length of the diameter). Note in FIG. 2 that Lc, Ld, Le and Lf represent the sizes of the substantial parts of the tooth-forming circles M1, M3. Also in FIG. 3, Sc, Sd, Se, Sf and Sg represent the sizes of the substantial parts of the tooth-forming circles N1, N3 and N4.

In the present embodiment, the outer rotor 2 is of internal gear type and has seven teeth, one tooth more than the inner rotor 1. A tooth 21 of the outer rotor 2 forms an envelope when the tooth A of the inner rotor 1 rotates. More specifically, the tooth 21 has a shape similar to that of the tooth A of the inner rotor 1.

In the present embodiment, the outer rotor 2 is provided with a gap (tens of micrometers) wide enough to be able to rotate smoothly with respect to the envelope of the inner rotor 1. Because the drive-side half-tooth region A1 and the non-drive-side half-tooth region A2 of the tooth A of the inner rotor 1 are in an asymmetrical relationship, the tooth 21 of the outer rotor 2, too, has an asymmetrical relationship between its front side and rear side with respect to the rotational direction of the outer rotor 2.

Operations of the rotors are now described. Suppose that the length of the circumferential axis Ja of the ellipse including the tooth top Qa of the drive-side half-tooth region A1 is 4.3 mm and that the length of the circumferential axis Ka of the ellipse including the tooth top Qa of the non-drive-side half-tooth region A2 is 4.45 mm. The non-drive-side half-tooth region A2 has an outline in which the top of the tooth is thick in the circumferential direction. The length of the circumferential axis Jb of the tooth root Qb of the drive-side half-tooth region A1 is 6.45 mm.

The length of the circumferential axis Kb of the ellipse including the tooth root Qc of the non-drive-side half-tooth region A2 is 7.3 mm. In this tooth A, the non-drive-side half-tooth region A2 has a wider tooth root in the circumferential direction. When the drive-side half-tooth region A1 and the non-drive-side half-tooth region A2 are disposed side-by-side, the non-drive-side half-tooth region A2 protrudes further in the circumferential direction at the top of the tooth. In addition, the drive-side half-tooth region A1 forms a smoother slope than the non-drive-side half-tooth region A2 does.

As described above, because the tooth top and tooth root of the non-drive-side half-tooth region A2 are circumferentially wider than those of the drive-side half-tooth region A1, the non-drive-side half-tooth region A2 has a circumferentially narrower intermediate region excluding the tooth top and tooth root. Moreover, the difference in radial height between the tooth top Qa and the tooth roots Qb, Qc is common between the drive-side half-tooth region A1 and the non-drive-side half-tooth region A2. Therefore, the circumferentially narrow intermediate region of the non-drive-side half-tooth region A2 has a steep slope.

Figure 4:
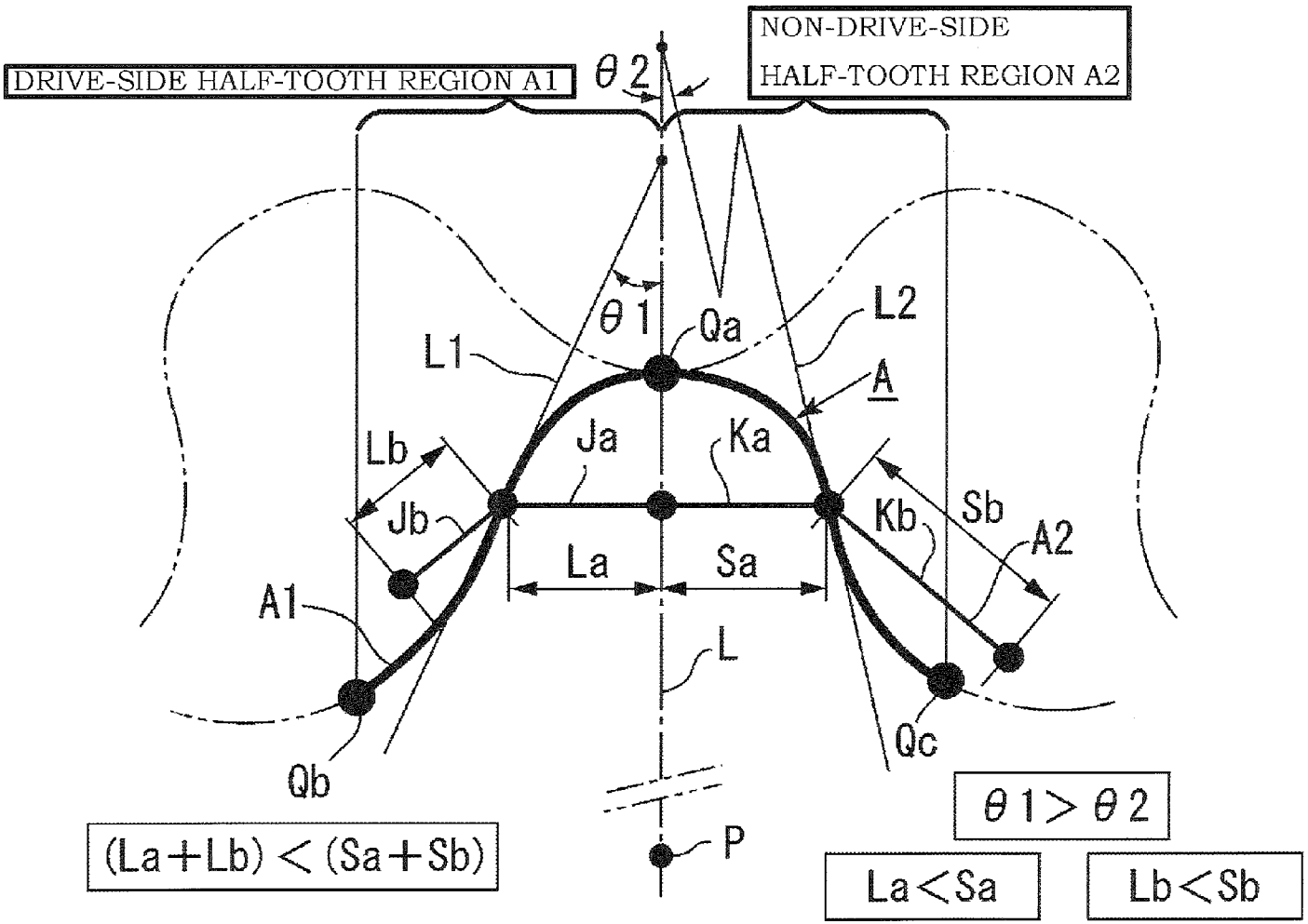
FIG. 4 is an enlarged view of a tooth of an inner rotor according to the present invention.

The configuration shown in FIG. 4 establishes the following inequality:

$\theta 1 > \theta 2$ where θ1 represents an angle formed between the virtual centerline L and a tangent line L1 of the intermediate region of the drive-side half-tooth region A1, and θ2 an angle formed between the virtual centerline L and a tangent line L2 of the intermediate region of the non-drive-side half-tooth region A2.

In this case, the gentler slope of the intermediate region of the drive-side half-tooth region A1 allows the angle at the inflection point on the ellipse or circle to change slowly. This can reduce the rattling sound on the drive side. In addition, the backlash clearance on the non-drive-side tooth is smaller than that on the drive side. FIG. 5 shows a state in which the tooth A of the inner rotor 1 and the tooth of the outer rotor 2 move while coming into smooth engagement with each other.

Figure 5A:
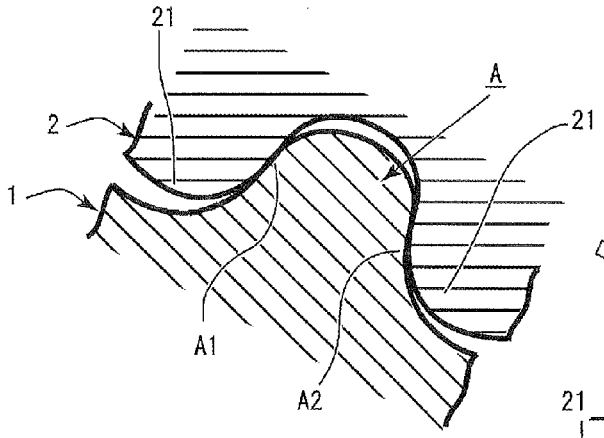
FIGS. 5A to 5D are diagrams showing how the engagement between a tooth of the inner rotor of the present invention and a tooth of an outer rotor of the same changes.
Figure 5B:
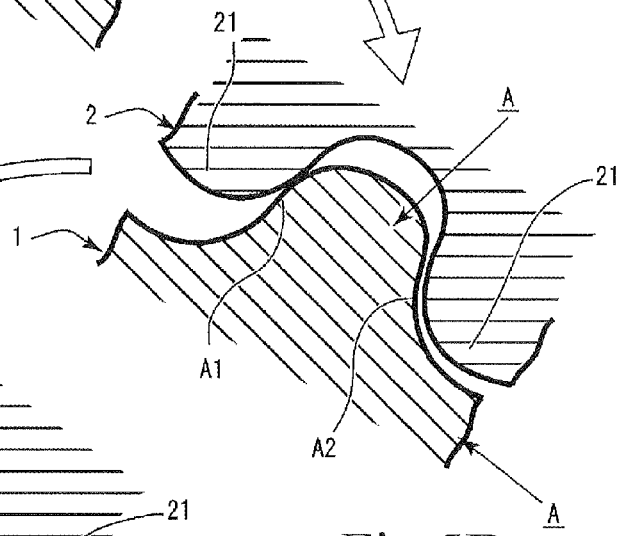
Figure 5C:
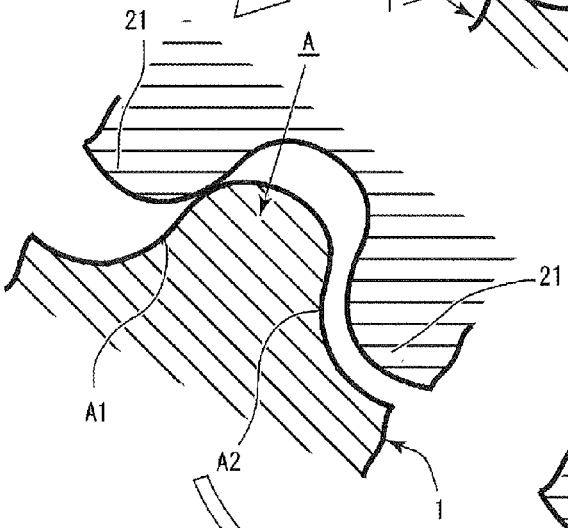
Figure 5D:
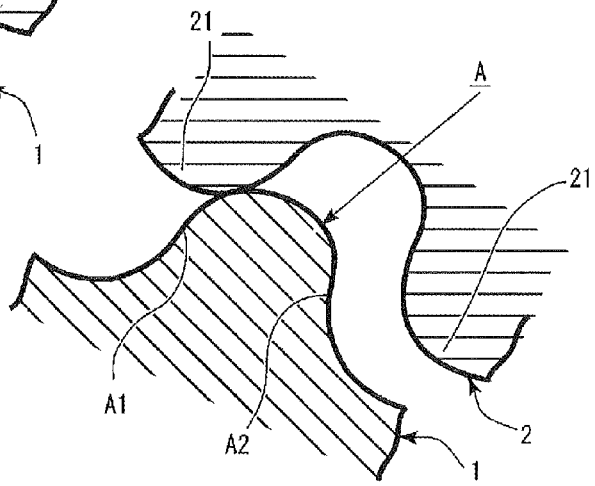

Particularly, FIG. 5A shows small backlash between the tooth 21 and the tooth A. Reducing the backlash can allow the inner rotor 1 and the outer rotor 2 to engage with each other smoothly, reducing noise. In this manner, the present invention can reduce noise on both the drive side and the non-drive side of the inner rotor.

What is claimed is:

1. A rotor for an oil pump, comprising:

an inner rotor part having a plurality of inner rotor teeth, each of which has a plurality of ellipses or circles; and an outer rotor part that is disposed on an outside of the inner rotor part, the outer rotor part having a plurality of outer rotor teeth, and has one outer rotor tooth more than the inner rotor part, wherein, in an inner rotor tooth of the plurality of inner rotor teeth, a tooth top and a tooth root of a drive-side half-tooth region extending from the tooth top to the tooth root and a tooth top and a tooth root of a non-drive-side half-tooth region extending from the tooth top to the tooth root are each configured by a different ellipse or a circle, and a circumferential axis along a circumferential direction of the ellipse or circle configuring the tooth top is longer in the non-drive-side half-tooth region than in the drive-side half-tooth region, and wherein a top of the tooth of the inner rotor part is in a shape of an ellipse, a root of the tooth in the non-drive-side half-tooth region of the inner rotor part is in a shape of an ellipse, and the teeth of the outer rotor part are each formed of an envelope that is formed when the teeth of the inner rotor part rotate.

2. The rotor for an oil pump according to claim 1, wherein a circumferential axis along a circumferential direction of the ellipse or circle configuring the tooth root is longer in the non-drive-side half-tooth region than in the drive-side half-tooth region.

3. The rotor according to claim 1, wherein the plurality of inner rotor teeth are each asymmetric.

4. The rotor according to claim 1, wherein the drive-side half-tooth region and the non-drive-side half-tooth region have an asymmetrical shape.

5. The rotor according to claim 1, wherein the non-drive-side half-tooth region is larger than the drive-side half-tooth region.

6. The rotor according to claim 1, wherein a difference in a radial height between the tooth top and the tooth root is common between the drive-side half-tooth region and the non-drive-side half-tooth region.

7. A rotor for an oil pump, comprising:

an inner rotor part having a plurality of inner rotor teeth, each of which has a plurality ellipses or circles; and an outer rotor part that is disposed on the outside of the inner rotor part, the outer rotor part having a plurality of outer rotor teeth, and has one outer rotor tooth more than the inner rotor part, wherein, in a tooth of the inner rotor part, a tooth top and a tooth root of a drive-side half-tooth region extending from the tooth top to the tooth root and a tooth top and a tooth root of a non-drive-side half-tooth region extending from the tooth top to the tooth root are each configured by a different ellipse or a circle, and a sum of the length of a circumferential axis along a circumferential direction of the ellipse or circle configuring the tooth top and the length of a circumferential axis along a circumferential direction of the ellipse or circle configuring the tooth root is greater in the non-drive-side half-tooth region than in the drive-side half-tooth region, and wherein a top of the tooth of the inner rotor part is in a shape of an ellipse, a root of the tooth in the non-drive-side half-tooth region of the inner rotor part is in a shape of an ellipse, and the teeth of the outer rotor part are each formed of an envelope that is formed when the teeth of the inner rotor part rotate.

8. The rotor according to claim 7, wherein the plurality of inner rotor teeth are each asymmetric.

9. The rotor according to claim 7, wherein the drive-side half-tooth region and the non-drive-side half-tooth region have an asymmetrical shape.

10. The rotor according to claim 7, wherein the non-drive-side half-tooth region is larger than the drive-side half-tooth region.

11. The rotor according to claim 7, wherein a difference in a radial height between the tooth top and the tooth root is common between the drive-side half-tooth region and the non-drive-side half-tooth region.

12. An oil pump, comprising:

a rotor including:

an inner rotor part having a plurality of inner rotor teeth, each of which has a plurality of ellipses; and an outer rotor part that is disposed on an outside of the inner rotor part, the outer rotor part having a plurality of outer rotor teeth, and has one outer rotor tooth more than the inner rotor part, wherein, in an inner rotor tooth of the plurality of inner rotor teeth, a tooth top and a tooth root of a drive-side half-tooth region extending from the tooth top to the tooth root and a tooth top and a tooth root of a non-drive-side half-tooth region extending from the tooth top to the tooth root are each configured by a different ellipse, and a circumferential axis along a circumferential direction of the ellipse configuring the tooth top is longer in the non-drive-side half-tooth region than in the drive-side half-tooth region, and wherein a top of the tooth of the inner rotor part is in a shape of an ellipse, a root of the tooth in the non-drive-side half-tooth region of the inner rotor part is in a shape of an ellipse, and the teeth of the outer rotor part are each formed of an envelope that is formed when the teeth of the inner rotor part rotate.

13. The oil pump according to claim 12, wherein the plurality of inner rotor teeth are each asymmetric.

14. The oil pump according to claim 12, wherein the drive-side half-tooth region and the non-drive-side half-tooth region have an asymmetrical shape.

15. The oil pump according to claim 12, wherein the non-drive-side half-tooth region is larger than the drive-side half-tooth region.

16. The oil pump according to claim 12, wherein a difference in a radial height between the tooth top and the tooth root is common between the drive-side half-tooth region and the non-drive-side half-tooth region.

* * * * *